US006244859B1

(12) United States Patent
Ragailler

(10) Patent No.: US 6,244,859 B1
(45) Date of Patent: Jun. 12, 2001

(54) ROTARY KILN

(76) Inventor: Franz Ragailler, Schmiedstrasse 6, A-4070 Eferding (AT)

( * ) Notice: Subject to any disclaimer, the term of this patent is extended or adjusted under 35 U.S.C. 154(b) by 0 days.

(21) Appl. No.: 09/632,416

(22) Filed: Aug. 4, 2000

(30) Foreign Application Priority Data

Aug. 25, 1999 (AT) ..... 1457/99

(51) Int. Cl.[7] ..... F27B 7/00

(52) U.S. Cl. ..... 432/103; 432/107; 432/112; 432/118; 432/119

(58) Field of Search ..... 432/103, 104, 432/107, 112, 118, 119; 110/246

(56) References Cited

U.S. PATENT DOCUMENTS 2,669,444 * 2/1954 Beetz ..... 432/119
5,033,959 * 7/1991 Bernt et al. ..... 432/118

FOREIGN PATENT DOCUMENTS 0 056 931 12/1981 (EP) .

* cited by examiner

*Primary Examiner*—Jiping Lu
(74) *Attorney, Agent, or Firm*—Collard & Roe, P.C.

(57) ABSTRACT

A rotary kiln (1) is equipped with a horizontal kiln drum (3), arranged rotatable and drivable in a furnace body (2), which kiln drum is closed at the charging and delivery side by end plates (4, 5) forming central charging or delivery openings (6, 7), respectively, and which can be heated from outside via a heating chamber (15) surrounding the drum shell and admitted with heating medium. To achieve a simple and solid drum construction at a good thermic efficiency, the kiln drum (3) consists of U-sections (18) arranged side by side along the drum circumference between the end plates (4, 5), which point radially inward with their open section side, and which are interconnected longitudinally in the touching end zones (19) of the section limbs (20), and along the circumference via reinforcing elements (23), having an axial distance to each other, bridging the remaining longitudinal gaps (21) between the section webs (22).

4 Claims, 1 Drawing Sheet

ROTARY KILN

FIELD OF THE INVENTION

The invention refers to a rotary kiln with a horizontal kiln drum arranged rotatable and drivable in a furnace body, which kiln drum is closed on the charging and delivery side by end plates forming central charging and/or delivery openings, and which can be heated from outside via a heating chamber admitted with a heating medium, which heating chamber surrounds the drum shell.

DESCRIPTION OF THE PRIOR ART

Rotary kilns for various combustion and gasification processes have been made in manifold embodiments, with the kiln drum as yet forming a flat-walled cylinder jacket, which, at its inside, has been equipped with ribs and webs for rearrangement and longitudinal conveyance of the material charged to the kiln and subjected to the desired combustion or gasification process. Simultaneously, these ribs and webs serving as conveying and conducting facility have increased the heat transfer surface of the kiln drum heated from outside, however, due to the indirect heat admission of the webs and ribs via the drum shell, the thermal yield has remained unsatisfactory. To prevent a major deflection of the kiln drums, which are produced in relatively long lengths, these must be made accordingly solid and with substantial wall thickness, which does not only increase the expenditure of construction, but also adversely affect the heat transfer from the heating chamber admitted with the heating medium to the material to be treated in the kiln. Moreover, due to the very high operating temperatures of the rotary kilns and, consequently, the substantial thermal expansion, the kiln drum must be suitable for taking up heat-related deformations, which means a further increase of the expenditure of manufacture, as well as an increase of the related thermic drawbacks for heating of the drum and for executing the relevant combustion and gasification processes.

SUMMARY OF THE INVENTION

Therefore, the invention has the task to create a rotary kiln of the above mentioned kind, which is characterised by a solid design on the one hand, and, on the other hand, by a high thermal-energetic yield at a comparably inexpensive construction.

The invention solves this task by constructing a kiln drum that consists of U-sections arranged side by side along the drum circumference between the end plates, the open section sides of which U-sections point radially inward and are interconnected longitudinally in the touching end zones of the section limbs, and at the circumference via reinforcing elements axially distant to each other and bridging the remaining longitudinal gaps between the section webs.

By this cylindrical placement of U-sections side by side a kiln drum is created with a kind of internal toothing via the U-sections, with the touching limb ends of the U-sections being welded together and the U-sections supporting each other in the web zone by means of the provided reinforcing elements. Thus a very solid composite U-section structure is achieved, as the adjoining U-section limbs with the related reinforcing elements constitute high-strength triangular cross sections providing the kiln drum with the necessary stability. This high stability permits the use of U-sections of relatively thin wall thickness, so that both the own weight can be kept low and the heat transfer properties through the drum shell are improved. Even with long rotary kilns, there is no problem of sagging, the heat-related expansions can be taken up without major additional reinforcements, and it is possible to equip the end plates provided for closing the kiln drum with bearing races or similar for pivoting and/or for sealing the kiln drum, as this can be inferred, for example, from AT-B 397.861. Apart from the strength and stability properties of the kiln drum, extremely favorable thermal yield conditions are achieved via this special drum cross section with its internal toothing, since the spaces remaining between the adjoining U-section limbs, which are triangular in cross section, are accessible from outside and can be applied with the heating medium in the heating chamber, so that not only accordingly larger heat transfer surfaces are available, but, due to the inwardly projecting section limbs, heat can also be input directly to the material taken along and rearranged by the section limbs inside the drum. This leads to the most favorable results of the performed combustion and gasification process, since the inwardly projecting section limbs take up the material, when the drum is rotated, rearrange the material and pass it on from section to section, which implies an intensive contact between the section parts and the material to be treated, and thus an accordingly high heat yield.

As reinforcing elements single connection plates may be welded between the section webs, however, it is more expedient to provide as reinforcing elements rings embracing the U-sections, which can be applied efficiently and can also be used as bearing races for bearing of the drum or similar, if required.

In order to achieve, in case of horizontal drum position, a conveyance effect in longitudinal direction beside the rearrangement of the material inside the kiln, conducting walls, cocked against the drum axis, preferably axially offset against each other from section to section, can be arranged in the section profiles for longitudinal conveyance of the charged kiln content, so that the charged material steadily passes through the drum from the charging to the delivery side and is subjected to the desired heat treatment on its conveying route.

Since the kiln drum is usually borne in the furnace body at its ends in the area of the end plates, the drum ends project out of the heating chamber on both sides, which as yet has implied a cooler end zone of the rotary kiln in this border area of the drum compared with the heating chamber area, which may lead to disturbances in the proceeding combustion or gasification process, especially in these transitional areas at the charging and/or delivery side. To prevent this by simple means, a sealing collar coaxial to the kiln drum and enclosing the ends of the U-sections projecting out of the heating chamber is applied between each end plate of the kiln drum and the adjacent connecting wall of the heating chamber, which does not only serve for heat insulation of the drum ends, but which also constitutes a kind of double shell for the drum ends admitted with heating medium on part of the heating chamber, and provides for regular process temperatures even in the areas of the drum ends. Moreover, these sealing collars constitute a suitable sealing of the kiln drum against the penetration of the heating chamber.

BRIEF DESCRIPTION OF THE DRAWING

The drawing depicts a schematic example of the subject matter of the invention.

DESCRIPTION OF THE PREFERRED EMBODIMENTS

Figure 1:
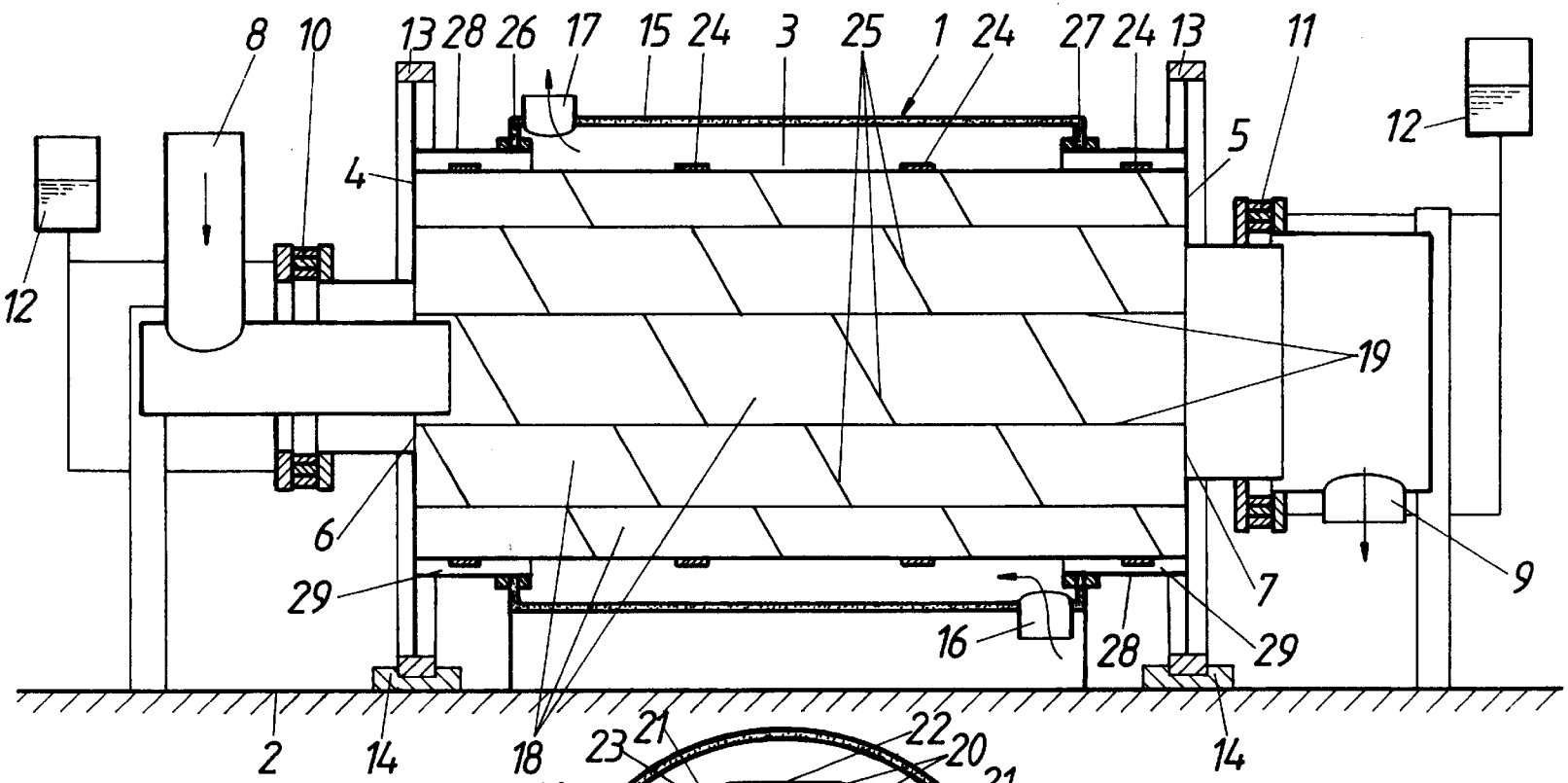
FIG. 1 shows a rotary kiln according to the invention in a longitudinal section and FIG. 2 shows a cross section through the kiln drum.
Figure 2:
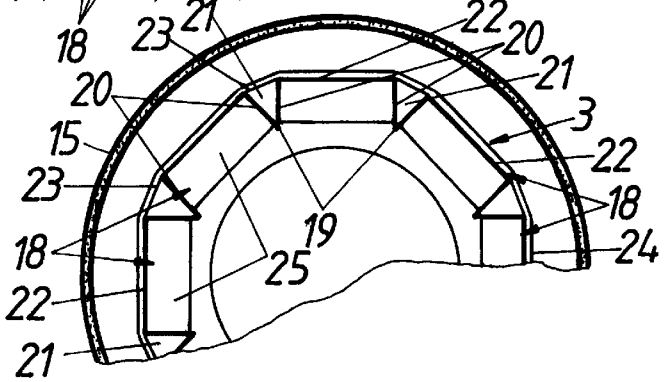

A rotary kiln 1 is equipped with a horizontal kiln drum 3 arranged rotatable and drivable in a furnace body 2, which is closed with end plates 4, 5 on the charging and delivery side. The end plates 4, 5 form central charging and/or delivery openings 6, 7 for putting on a charging 8 or delivery facility 9, respectively, sealed via girth sealings 10, 11 against the rotating kiln drum 3, which girth sealings 10, 11 encompass a sealing liquid system 12. At its end plates 4, 5 the kiln drum 3 is provided with external bearing races 13, which cooperate with the corresponding bearing blocks 14 of the furnace body 2 to support and pivot the drum.

To heat the rotary kiln a heating chamber 15 is provided, which surrounds the drum shell and through which a heating medium is flowing via appropriate feeding and discharge pipes 16, 17, so that heat is applied to the kiln drum from outside.

To achieve a highly solid kiln drum 3 and simultaneously furnish the prerequisites for an especially effective heat input to the material to be treated inside the kiln via the kiln drum, the kiln drum 3 consists of U-sections 18 arranged side by side along the drum circumference between the end plates 4, 5, pointing radially inward with their open section sides. These U-sections 18 are welded together longitudinally along the touching end zones 19 of the section limbs 20, and are interconnected at the circumference via reinforcing elements 23, having an axial distance from each other and bridging the remaining longitudinal gaps 21 between the section webs 22, which reinforcing elements 23 may be single web plates, but are preferably embodied as rings 24 embracing the U-sections 18. By means of this kiln drum 3 composed of U-sections 18, not only a highly solid drum structure demanding only thin wall thicknesses is achieved due to the triangular girder systems created between the individual U-sections 18, but, due to the U-sections pointing inward, the material to be treated inside the kiln is also thoroughly mixed and uniformly laid during the treatment. Moreover, the longitudinal gaps 21 between the U-sections 18, accessible from outside, ensure an admission with heating medium, even of the section limbs 20 projecting into the interior of the kiln, thus providing for an accordingly efficient heat yield via large heat transfer surfaces.

To be able to convey the material to be treated in the kiln from the charging facility 8 to the delivery facility 9, with the drum axis A running horizontally, it is sufficient for longitudinal conveyance of the charged kiln content to arrange conducting walls 25 in the U-sections 18, cocked against the drum axis A, and preferably axially offset against each other from section to section.

The kiln drum 3 projects out of the heating chamber 15 on both sides, and is borne at the furnace body 2 ouside the heating chamber 15 via its bearing races 13. To avoid a cooling zone in the transition area between the heating chamber 15 and the end plates 4, 5, a sealing collar 28 is applied between each end plate 4, 5 of the kiln drum 3 and the adjacent sealing wall 26, 27 of the heating chamber 15, which sealing collar is coaxial to the kiln drum 3 and surrounds the ends of the U-sections 18 projecting out of the heating chamber 15. These collars 28 provide for a heat insulation of the drum end zone on the one hand, and constitute a double shell 29, on the other hand, permitting admission with heating medium of the drum up to the end plates 4, 5.

What is claimed is:

1. Rotary kiln with a horizontal kiln drum arranged rotatable and drivable in a furnace body, which is closed at a charging and a delivery side by end plates forming central charging and delivery openings, respectively, and which can be heated from outside via a heating chamber enclosing a drum shell and admitted with heating medium, characterised by the fact that the kiln drum (3) consists of U-sections (18) arranged side by side along a drum circumference between the end plates (4, 5), which point radially inward with their open section side, and which are interconnected longitudinally at touching end zones (19) of section limbs (20), and at the circumference via reinforcing elements (23) having an axial distance to each other, and bridging remaining longitudinal gaps (21) between section webs (22).

2. Rotary kiln according to claim 1, characterised by the fact that rings (24) embracing the U-sections (18) are provided as reinforcing elements (23).

3. Rotary kiln according to claim 1, characterised by the fact that, for longitudinal conveyance of the charged kiln content, conducting walls (25) are arranged in the U-sections (18), cocked against a drum axis (A), preferably axially offset against each other from section (18) to section (18).

4. Rotary kiln according to claim 1, with the kiln drum (3) projecting out of the heating chamber (15) on both sides, characterised by the fact that a sealing collar (28) is applied between each end plate (4, 5) of the kiln drum (3) and adjoining sealing walls (26, 27) of the heating chamber (15), which is coaxial to the kiln drum (3) and which surrounds ends of the U-sections (18) projecting out of the heating chamber (15).

* * * * *